US005860526A

United States Patent [19]

Burke, Jr.

[11] Patent Number: 5,860,526

[45] Date of Patent: Jan. 19, 1999

[54] APPARATUS AND METHOD FOR RETAINING A CYLINDRICAL SHAPED PRODUCT OR CONTAINER WITHIN A SHADOW CARTON SO THAT THE FRONT LABEL ON THE PRODUCT OR CONTAINER DOES NOT ROTATE OUT OF VIEW

[75] Inventor: Richard M. Burke, Jr., Thousand Oaks, Calif.

[73] Assignee: Performance Labs, Inc., Calabasas, Calif.

[21] Appl. No.: 911,453

[22] Filed: Aug. 14, 1997

[51] Int. Cl.[6] ..... B65D 25/54

[52] U.S. Cl. ..... 206/446; 206/459.5; 206/460; 206/775

[58] Field of Search ..... 206/460, 736, 206/756, 769, 775–783, 813, 459.5, 446; 229/241, 162

[56] References Cited

U.S. PATENT DOCUMENTS

| | | | |
|---|---|---|---|
| D. 372,423 | 8/1996 | Cook . | |
| 3,065,896 | 11/1962 | Grapp | 229/241 |
| 3,204,759 | 9/1965 | Palmer | 206/775 |
| 3,592,338 | 7/1971 | Hanson et al. . | |
| 3,747,831 | 7/1973 | Hanson | 206/277 |
| 3,750,870 | 8/1973 | Cote . | |
| 3,819,035 | 6/1974 | Jaeschke . | |
| 3,901,382 | 8/1975 | Roccaforte . | |
| 4,037,717 | 7/1977 | Roccaforte . | |
| 4,191,289 | 3/1980 | Austin . | |
| 4,197,981 | 4/1980 | Hamilton . | |
| 5,265,794 | 11/1993 | Johnston . | |
| 5,452,850 | 9/1995 | Allsop . | |

*Primary Examiner*—Jim Foster
*Attorney, Agent, or Firm*—Thomas I. Rozsa; Tony D. Chen; Jerry Fong

[57] ABSTRACT

An apparatus and method of retaining a cylindrical shaped product or container within a shadow carton so that the front label on the product or container does not rotate out of view. The shadow carton comprises an opening to enable the lower portion of the carton to be closed with an adhesive that is then attached to the bottom end of the cylindrical product or container so that the product or container essentially is glued to the bottom of the carton and will not rotate out of position. The bottom of the carton comprises a lower portion with an opening and two side flaps that are cut and scored so that the opening still remains exposed until the bottom of the carton is folded. Adhesive is applied to the bottom of the carton in order to then seal the bottom. However, prior to the sealing, the product or container itself is inserted into the carton so that when the adhesive is applied and the bottom closed, the adhesive will go through the opening in the carton and adhere to the bottom of the product or container so that the product or container will remain stable and does not rotate within the shadow carton. The carton is glued shut at the top. Then the product or container is inserted into the shadow box so that the label appears through the opening in the shadow box. Then the bottom is closed and then glued with the adhesive not only sealing the bottom of the carton but going through the opening so that it can be affixed to the bottom of the product or container to make sure the product or container is oriented in the proper direction and remains in the proper orientation.

20 Claims, 2 Drawing Sheets

FIG.2
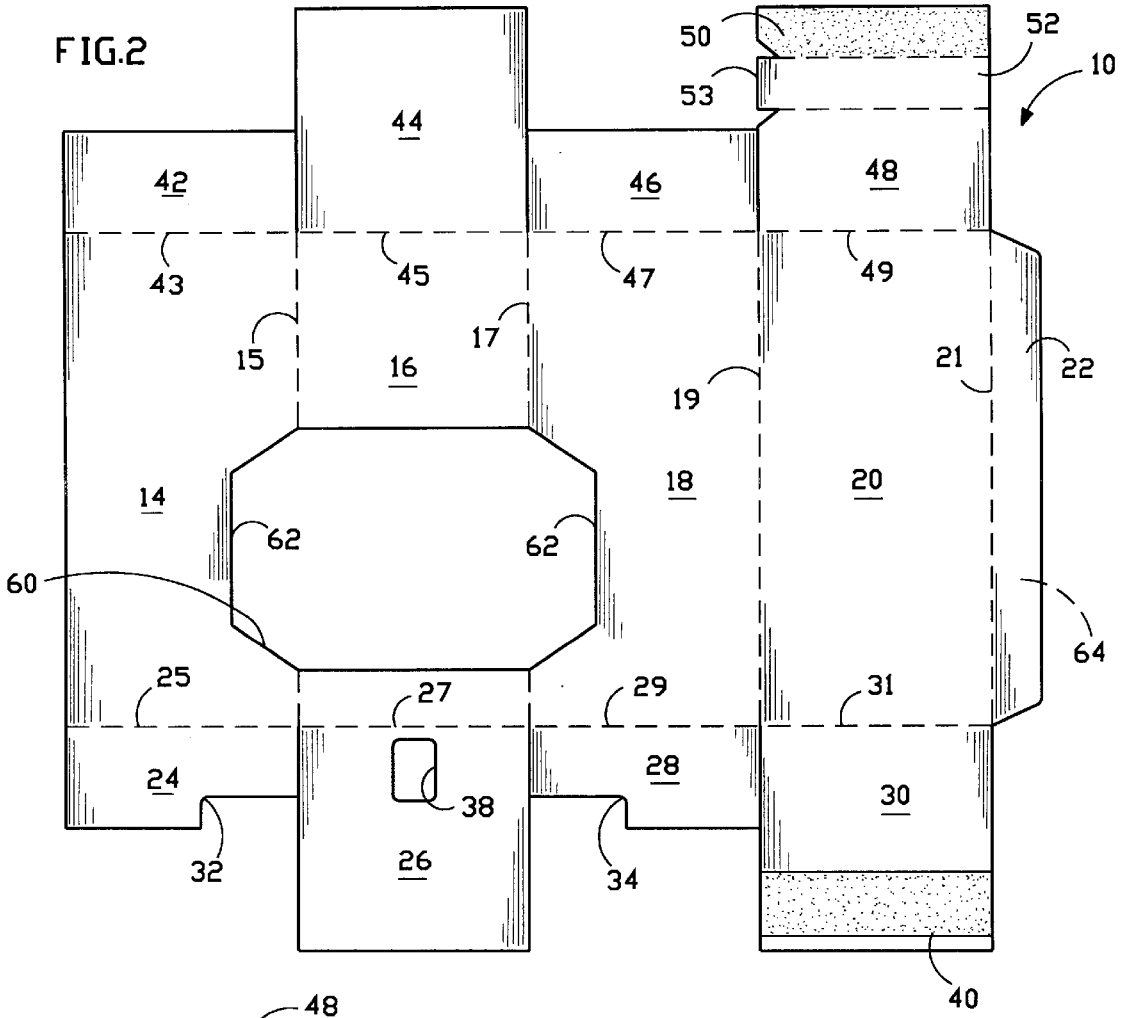
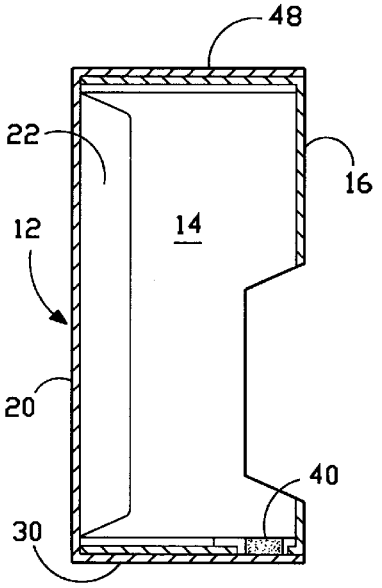
FIG.5

APPARATUS AND METHOD FOR RETAINING A CYLINDRICAL SHAPED PRODUCT OR CONTAINER WITHIN A SHADOW CARTON SO THAT THE FRONT LABEL ON THE PRODUCT OR CONTAINER DOES NOT ROTATE OUT OF VIEW

BACKGROUND OF THE INVENTION

1. Field of the Invention

The present invention generally relates to the field of packaging of consumer products. More particularly, the present invention relates to an apparatus and method of retaining a cylindrical shaped container within a standard shadow carton which has a front opening for displaying the label on the product.

2. Description of the Prior Art

A shadow carton is a carton having sidewalls, top and bottom walls, a rear wall, and a front wall panel structure which provide a close fitting frame for a product and in particular, a container, to be displayed and viewed from the front opening of the carton. The problem that has been experienced with ordinary shadow carton packaging is that the cylindrical shaped container can be rotated within the shadow carton packaging resulting in the front label being rotated out of view, and therefore it is often necessary for store clerks to rotate it back into view.

The following ten (10) prior art patents are found to be pertinent to the field of the present invention:

1. U.S. Pat. No. 3,592,338 issued to Hanson et al. on Jul. 13, 1971 for "Display Carton" (hereafter the "Hanson Patent");

2. U.S. Pat. No. 3,750,870 issued to Cote on Aug. 7, 1973 for "Shadow Box Carton" (hereafter the "Cote Patent");

3. U.S. Pat. No. 3,819,035 issued to Jaeschke on Jun. 25, 1974 for "Frame Carton" (hereafter the "Jaeschke Patent");

4. U.S. Pat. No. 3,901,382 issued to Roccaforte on Aug. 26, 1975 for "Tube Display Carton" (hereafter the "'382 Roccaforte Patent");

5. U.S. Pat. No. 4,037,717 issued to Roccaforte on Jul. 26, 1977 for "Display Carton" (hereafter the "'717 Roccaforte Patent");

6. U.S. Pat. No. 4,191,289 issued to Austin on Mar. 4, 1980 for "Hourglass Carton" (hereafter the "Austin Patent");

7. U.S. Pat. No. 4,197,981 issued to Hamilton on Apr. 15, 1980 for "Self-Locking, Reclosable Carton" (hereafter the "Hamilton Patent");

8. U.S. Pat. No. 5,265,794 issued to Johnston on Nov. 30, 1993 for "Tamper Evident Folding Carton" (hereafter the "Johnston Patent");

9. U.S. Pat. No. 5,452,850 issued to Allsop on Sep. 26, 1995 for "Reclosable Dispensing Carton" (hereafter the "Allsop Patent"); and 10. U.S. Design Pat. No. 372,423 issued to Cook on Aug. 6, 1996 for "Display Container" (hereafter the "Cook Patent").

The Hanson Patent discloses a display carton which is made of one piece of sheet material having a plurality of serially connected panels that form an outer rectangular box unit and an inner shadow panel unit. The shadow panel unit includes a pair of shadow panels which are arranged to present oblique faces to the window opening in the carton.

The Cote Patent discloses a shadow box carton in which an article supporting strap extends completely across the front of the carton. The strap includes foldable articulated gusset members formed from the leading edges of the opposite sidewalls of the carton and integral contiguous portions formed from the front wall of the carton immediately above the uppermost portions of each of the shadow panels. The central portions of the strap bridge the upper edges of the two shadow panels. These central portions are articulated along a vertical score which is collinear with the cut dividing the lower portions of the front panel into the shadow panels.

The Jaeschke Patent discloses a shadow box type package which supports a tube having a crimped end. The carton includes a closure which has a first flap connected to one wall and inclined inwardly toward the opposite wall. The first flap is apertured to receive the tube end, and includes an extension extending to the juncture between the opposite wall and a second flap. The second flap extends across the carton end and includes a tuck flap engageable through the aperture in the first flap.

The '382 Roccaforte Patent discloses a tube display carton for storing and displaying squeeze tubes. It comprises a foldable paperboard having a transverse cut across the upper end of the front panel with the lower section formed into two shadow panels with an opening in the middle to receive a squeeze tube. At the lower end of the opening are secondary shadow panels at a second angle and flaps at the bottom of the opening which are hinged to fold inwardly and frictionally engage and retain the cap in position and to prevent rotation of the cap.

The '717 Roccaforte Patent discloses a display carton. It comprises a top portion and a bottom portion of a front panel in position to frame the article to be displayed and die cut folded sections at the top and bottom of the carton to support and restrain the article away from the end panels of the carton.

The Austin Patent discloses an hourglass carton. It comprises end walls adapted to engage the ends of the article for inhibiting longitudinal movement.

The Hamilton Patent discloses a self-locking, reclosable carton. It comprises a floor panel and sidewall panels. Each sidewall panel has two inner edge panels which are folded inwardly at the ends of the floor panel. The floor panel has outer end panels which are locked in slightly spaced relationship to the inner end panels by tab members which are forced through narrow openings at the edges of the inner end panels.

The Johnston Patent discloses a tamper evident folding carton. It comprises tamper indicating seals at opposite ends, wherein each end comprises four infolded flaps sealed to one another through registered slots in the intermediate flaps. The seals will be triggered by an attempted violation of the carton integrity through the carton side seam.

The Allsop Patent discloses a shaker type reclosable dispensing carton which comprises an intermediate top closure flap. The closure flap has poring holes located in a despressible portion of the flap which can be depressed into the plane of an underlying flap, when the carton is reclosed, to allow a hinged outer closure flap pull-up portion to be depressed into the plane of the intermediate flap to effect a friction type locking closure between the intermediate and outer closure flaps.

The Cook Patent discloses a display container which comprises several display openings.

It is desirable to have a very efficient and also very effective design and construction of an apparatus and method of retaining a cylindrical shaped product within a shadow carton which has means to prevent the front label from rotating out of view, thereby eliminating the need for store clerks to rotate it back into view.

SUMMARY OF THE INVENTION

The present invention is an apparatus and method of retaining a cylindrical shaped product and in particular, a container which contains product therein and has a front label on at least a portion of its exterior surface, the container housed within a shadow box or carton with means to prevent the front label from rotating out of view. The shadow carton includes an opening to enable the lower end of the carton to be closed with an adhesive means that is then attached to the bottom of the cylindrical shaped container so that the container essentially is glued to the bottom of the carton and will not rotate out of position. The bottom of the carton includes a lower portion with an opening and two side flaps that are cut and scored so that the opening still remains exposed until the bottom of the carton is folded. Adhesive means is applied to the bottom of the carton in order to seal the lower end. However, prior to the sealing, the product or container itself is inserted into the carton so that when the adhesive means is applied and the bottom closed, the adhesive means extends through the opening in the carton and adheres to the bottom of the product or container so that the product or container will remain stable and does not rotatable within the shadow carton.

In one preferred embodiment, the initial step is to close the top of the carton through the simple process as described above and have it glued shut. Then the cylindrical shaped product or container is inserted into the shadow carton so that the label appears through the opening in the shadow carton. Then the bottom is closed and then glued with the adhesive means not only sealing the bottom of the carton but extending through the opening so that it can be affixed to the bottom of the product or container to make sure the product or container is oriented in the proper direction and remains in the proper orientation. It is a simple type of glue which can be removed and torn off once the object is removed from the shadow carton so that there will not be any adhesive on the bottom of the product or container when it is in normal use.

It is an object of the present invention to provide a new and improved shadow carton for packaging a cylindrical shaped product or container with a label thereon, which has means to prevent the cylindrical shaped product or container from rotating so that the label rotates out of view.

It is also an object of the present invention to provide a method of retaining a cylindrical shaped object or the like within a shadow carton so that the front label on the object cannot be rotated out of view.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 2 is a plan view of a blank embodying the principles of the present invention from which a new and improved shadow carton may be formed;

FIG. 5 is a cross-sectional view taken along lien 5—5 of FIG. 4.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
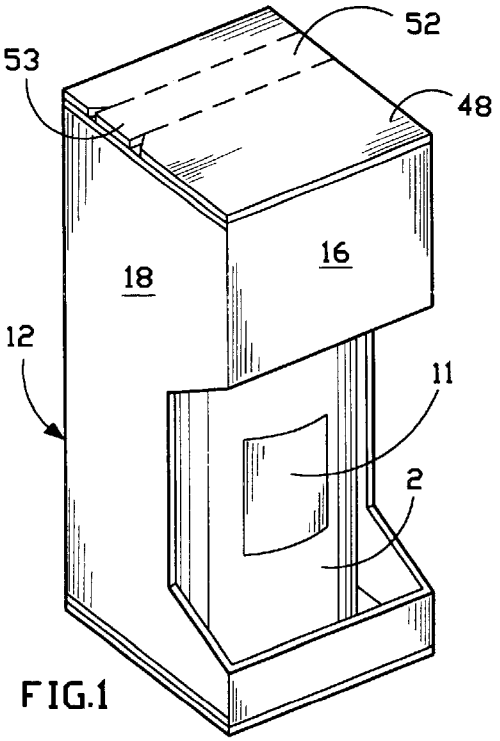
FIG. 1 is a perspective view of the present invention new and improved shadow carton, showing a cylindrical shaped product or container retained within the formed shadow carton.
Figure 3:
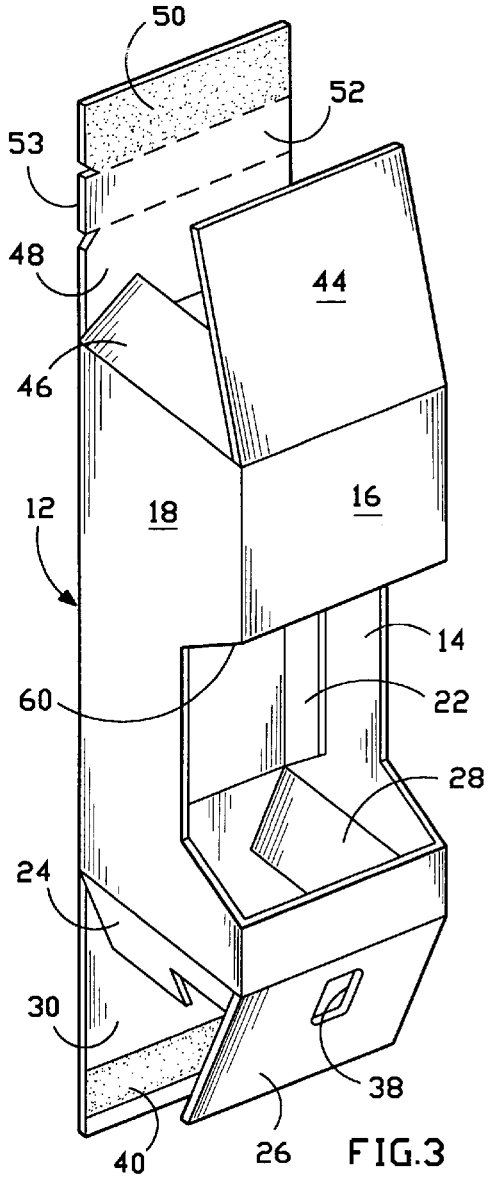
FIG. 3 is a perspective view of the present invention new and improved shadow carton, showing the intermediate stages of its formation.
Figure 4:
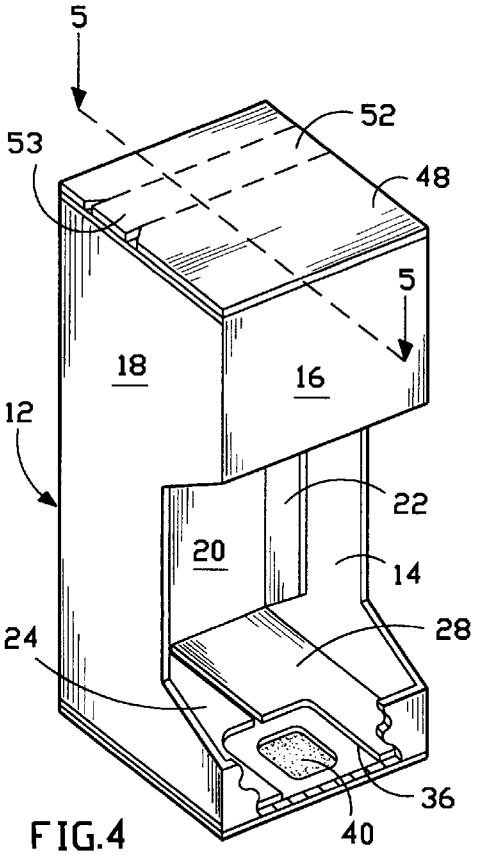
FIG. 4 is a partial perspective cutout view of the present invention new and improved shadow carton, showing the formed shadow carton without the cylindrical shaped product or container therein.

Described briefly, the present invention is an apparatus and method for retaining a cylindrical shaped product or container have a label on the product's or container's exterior surface within a shadow box or carton so that the front label on the product or container cannot be rotated out of view (see FIG. 1).

Referring to FIG. 2, there is depicted at 10 an unitary blank of foldable sheet material, such as paperboard from which the present invention of a new and improved shadow carton may be erected, indicated generally at 12 in FIGS. 1, 3, 4 and 5.

Referring to FIGS. 1 and 2, the shadow carton 12 is generally a rectangular shaped structure comprising a first sidewall panel 14, a front wall panel 16, a second sidewall panel 18, a rear wall panel 20, and a glue panel 22, which have adjacent side edges foldably joined to each other along vertical parallel fold or score lines 15, 17, 19, and 21, respectively.

Referring to FIGS. 1, 2, 3, and 4, in accordance with the principles of the present invention, the front wall panel 16 has a display window 60 which is formed by cutting part of the front wall panel 16 away to form a generally square shaped window for viewing the product 2 therein. The display window 60 is generally located at the lowermost portion of the front wall panel 16. In addition, the two sidewall panels 14 and 18 each have a partial cutoff portion 62 which extends inwardly into the panel. The cutoff portion 62 corresponds with the height and width of the display window 60 at opposite sides of the display window 60.

Referring to FIGS. 2, 3, 4, and 5, the closure arrangement for the lower end of the shadow carton 12 is designed for retaining the cylindrical shaped product or container 2 therein so that the front label 11 on the product or container cannot be rotated out of view. As defined herein, the label 11 can either be a separate label affixed to the product or container or printed indicia printed or silkscreened onto the product or container. The lower end of the shadow carton 12 is closed by lower end closure flaps which includes a first side closure flap 24, a second side closure flap 28, an inner closure flap 26, and an outer closure flap 30, which are respectively foldably joined to the lower end edges of wall panels 14, 18, 16, and 20 along fold or score lines 25, 29, 27, and 31, respectively. The inner closure flap 26 has a central opening 38 therethrough which is located adjacent to the fold line 27. The outer closure flap 30 has adhesive means 40 partially covering the inner surface and opposite the fold line 31. The side closure flaps 24 and 28 are each preferably L-shaped and have adjacent inner edges that meet at the center of the carton. The side closure flaps 24 and 28 have opposed adjacent recesses 32 and 34 respectively, which form a common opening 36 when the carton 12 is erected and the side closure flaps 24 and 28 are positioned in a common plane. When the lower end of the carton 12 is closed, the two side closure flaps 24 and 28 are first folded inwardly toward each other to form the common opening 36, and then the inner closure flap 26 is folded inwardly such that the central opening 38 is parallel to and aligned with the common opening 36. The outer closure flap 30 is then folded inwardly and adhesively secured to the inner closure flap 26 in overlapped relationship such that part of the adhesive means 40 is located within the central opening 38 and extends inwardly into the carton 12 (see FIG. 4). The adhesive means 40 may have a removable cover (not shown) which covers the adhesive means 40 and is peeled off when the adhesive means 40 is ready to be used. The adhesive means may be glue, tape, epoxy or any other suitable means.

The closure arrangement for the upper end of the shadow carton 12 is closed by upper end closure flaps which include an upper first side closure flap 42, an upper second side closure flap 46, an upper inner closure flap 44, and an upper outer closure flap 48, which are respectively foldably joined to the upper end edges of wall panels 14, 18, 16, and 20 along fold or score lines 43, 47, 45, and 49, respectively. The upper outer closure flap 48 has an adhesive means 50 which is partially covering the inner surface and located opposite the fold line 49. In addition, the upper outer closure flap 48 has a tear away portion 52 with a lift tap 53, which may be torn off from the upper outer closure flap 48 to open the carton 12 to remove the product or carton 2 therein. The upper side closure flaps 42 and 46 have adjacent inner edges that meet at the center of the carton. When the upper end of the carton 12 is closed, the two side closure flaps 42 and 46 are first folded inwardly toward each other, and then the inner closure flap 44 is folded inwardly on the top of the two side closure flaps 42 and 46. The outer closure flap 48 is then folded inwardly and adhesively secured to the inner closure flap 44 in overlapped relationship. The adhesive means 50 may have a removable cover paper (not shown) which covers the adhesive means 50 and is peeled off when the adhesive means 50 is ready to be used.

The shadow carton of the present invention may be erected and filled as follows. The rectangular shaped structure is initially formed by respectively folding the panels 14, 16, 18, and 20 about the fold lines 15, 17, 19, and 21. The longitudinal free edge of sidewall panel 14 is then placed over the glue panel 22 and adhering the longitudinal strip of an adhesive means 64 or glue panel 22 thereon to the portions of the sidewall panel 14 opposite the fold line 15. The bottom end of the shadow carton 12 is completed as described above. After the bottom end of the shadow carton 12 is formed, the product or container to be packaged in the shadow carton 12 is inserted into the shadow carton. The product or container 2 is then oriented in the proper direction and remains in the proper orientation, so that the label 11 on the product or container 2 appears through the display window 60 such that when the adhesive means 40 is applied and the bottom end closed, the adhesive means 40 extends through the opening 38 and into the carton 12 and adheres to the bottom of the cylindrical shaped product or container 2 so that the product or container remains stable and is not rotatable within the shadow carton, where the label 11 on the product or container is seen through the display window 60. The top end of the shadow carton 12 is then completed as described above.

Referring to FIG. 1, in order to open the shadow carton 12 and remove the cylindrical shaped product or container 2 therefrom, the lift tab 53 of the tear away portion 52 is grasped and pulled up to remove the tear away portion 52 from the upper outer closure flap 48, thereby opening the shadow carton 12 to remove the product.

It will be appreciated that the present invention is not limited to the rectangular shaped structure. It is emphasized that while the rectangular shaped structure is the preferred structure, it is also within the spirit and scope of the present invention to utilize a triangular shaped structure or a cylindrical shaped structure for the shadow carton or etc.

The present invention conforms to conventional forms of manufacture or any other conventional way known to one skilled in the art, and is of simple construction and is easy to use.

Defined in detail, the present invention is a shadow carton for retaining and displaying therein a cylindrical shaped product or container having a label on its exterior surface, the shadow carton comprising: (a) a front wall panel, an opposed rear wall panel, a first sidewall panel, and an opposed second sidewall panel, foldably joined to each other to form a rectangular shaped structure open at upper and lower ends, the front wall panel having a display opening for viewing the label on the exterior surface of said cylindrical shaped product or container; (b) a pair of lower side closure flaps foldably joined to lower edges of the first and second sidewall panels, and folded inwardly toward each other such that their adjacent free edges abut against each other at a center of the rectangular shaped structure, each lower side closure flap having an adjacent recess that cooperate with each other to form a common opening; (c) a lower inner closure flap foldably joined to a lower edge of the front wall panel and having a central opening located adjacent to the lower edge of the front wall panel, the inner closure flap folded inwardly over the pair of lower side closure flaps such that the central opening is parallel to and corresponds with the common opening; (d) a lower outer closure flap foldably joined to a lower edge of the rear wall panel and having an adhesive means located opposite to the lower edge of the rear wall panel, the outer closure flap folded inwardly toward the front wall panel to close the lower end of the rectangular shaped structure such that the adhesive means adheres to the inner closure flap in overlapped relationship, where the adhesive means extends through the central opening and the common opening for attaching to the cylindrical shaped product or container to prevent the label from rotating out of view from the display opening; (e) a pair of upper side closure flaps foldably joined to upper edges of the first and second sidewall panels and folded inwardly therefrom toward each other such that their adjacent free edges abut against each other; (f) an upper inner closure flap foldably joined to an upper edge of the front wall panel, and folded inwardly therefrom toward the rear wall panel and over the pair of upper side closure flaps; and (g) an upper outer closure flap foldably joined to an upper edge of the rear wall panel and folded inwardly therefrom toward the front wall panel and over and secured to the upper inner closure flap to close the upper end of the rectangular shaped structure in overlapped relationship; (h) whereby the cylindrical shaped product or container is retained within the rectangular shaped structure and the adhesive means prevents the label on the product or container from rotating out of view from the display opening.

Defined broadly, the present invention is a carton for retaining and displaying therein a product or container having a label on its exterior surface, the carton comprising: (a) two opposed pairs of first and second wall panels foldably joined to each other to form a structure open at upper and lower ends, one of the first pair of wall panels having a display opening for viewing the label on the product or container; (b) a pair of lower flaps foldably joined to lower edges of the second pair of wall panels, and folded inwardly toward each other such that their adjacent free edges abut against each other, each lower flap having an adjacent slit that cooperates with each other to form a common opening; (c) a lower inner flap foldably joined to a lower edge of one of the first pair of wall panels and having an opening therethrough, the lower inner flap folded inwardly over the pair of lower flaps such that the opening is located parallel to and corresponds with the common opening; (d) a lower outer flap foldably joined to a lower edge of the other one of the first pair of wall panels and having an adhesive means thereon, the lower outer flap folded inwardly toward one of the first pair of wall panels to close the lower end of the structure such that the adhesive means adheres to the lower inner flap in overlapped relationship, where the adhesive means also extends through the opening and the common opening for attaching to the product and preventing the label from rotating out of view from the display opening; (e) a pair of upper flaps foldably joined to upper edges of the second pair of wall panels and folded inwardly therefrom toward each other such that their adjacent free edges abut against each other; (f) an upper inner flap foldably joined to an upper edge of one of the first pair of wall panels, and folded inwardly therefrom and over the pair of upper flaps; and (g) an upper outer flap foldably joined to an upper edge of the other one of the first pair of wall panels and folded inwardly therefrom over and secured to the upper inner flap to close the upper end of the structure in overlapped relationship; (h) whereby the product or container is retained within the structure and the adhesive means prevents the label on the product or container from rotating out of view from the display opening.

Defined more broadly, the present invention is a carton for retaining and displaying therein a product or container, comprising: (a) at least three panels foldably joined to each other to form a structure open at upper and lower ends, a respective one of the at least three panels having an opening for viewing a label on the product or container; (b) at least one lower flap foldably joined to a lower edge of the respective one of the at least three panels and secured thereto, the at least one lower flap having an adhesive means thereon, and folded inwardly therefrom to close the lower end of the structure and for attaching to the product or container to prevent the label from rotating out of view from the viewing opening; and (c) at least one upper flap foldably joined to an upper edge of the respective one of the at least three panels and secured thereto for closing the upper end of the structure; (d) whereby the product or container is retained within the structure and the adhesive means prevents the label of the product from rotating out of view from the viewing opening.

Defined even more broadly, the present invention is a carton for retaining and displaying therein a product or container, comprising: (a) a structure having a circumferential sidewall, a top wall for closing an upper end of the structure, a bottom wall for closing a lower end of the structure, the sidewall having an opening for viewing and displaying a portion of the product or container; and (b) the structure further having a sealing location with an adhesive means for attaching the product or container and preventing the viewed portion of the product or container from rotating out of view from the viewing opening; (c) whereby the product or container is retained within the structure and the adhesive means prevents the viewed portion of the product or container from rotating out of view from the viewing opening.

Alternatively defined in detail, the present invention is a method of retaining a cylindrical shaped product or container within a shadow carton to prevent a front label on said product or container from rotating out of view, the method comprising the steps of: (a) foldably joining a front wall panel, an opposed rear wall panel, a first sidewall panel, and an opposed second sidewall panel to each other to form a rectangular shaped structure open at upper and lower ends; (b) cutting a display opening on the front wall panel for viewing the label on the cylindrical shaped product or container; (c) foldably joining a pair of lower side closure flaps to lower edges of the first and second sidewall panels, and folded inwardly toward each other such that their adjacent free edges abut against each other at a center of the rectangular shaped structure; (d) cutting an adjacent recess on the each lower side closure flap that cooperate with each other to form a common opening; (e) foldably joining a lower inner closure flap to a lower edge of the front wall panel and having a central opening located adjacent to the lower edge of the front wall panel, the inner closure flap folded inwardly over the pair of lower side closure flaps such that the central opening is parallel to and corresponds with the common opening; (f) foldably joining a lower outer closure flap to a lower edge of the rear wall panel and having an adhesive means located opposite to the lower edge of the rear wall panel, the outer closure flap folded inwardly toward the front wall panel to close the lower end of the rectangular shaped structure such that the adhesive means adheres to the inner closure flap in overlapped relationship, where the adhesive means extends through the central opening and the common opening; (g) further attaching the cylindrical shaped product or container with the adhesive means to prevent the label on the cylindrical shaped product or container from rotating out of view from the display opening; (h) foldably joining a pair of upper side closure flaps to upper edges of the first and second sidewall panels and folded inwardly therefrom toward each other such that their adjacent free edges abut against each other; (i) foldably joining an upper inner closure flap to an upper edge of the front wall panel, and folded inwardly therefrom toward the rear wall panel and over the pair of upper side closure flaps; and (j) foldably joining an upper outer closure flap foldably joined to an upper edge of the rear wall panel and folded inwardly therefrom toward the front wall panel and over and secured to the upper inner closure flap to close the upper end of the rectangular shaped structure in overlapped relationship; (k) whereby the cylindrical shaped product or container is retained within the rectangular shaped structure and the adhesive means prevents the label of the product or container from rotating out of view from the display opening.

Alternatively defined broadly, the present invention is a method of retaining a product within a carton to prevent a front label from rotating out of view, the method comprising the steps of: (a) foldably joining at least three panels to each other to form a structure open at upper and lower ends; (b) cutting an opening on a respective one of the at least three panels for viewing the label of the product; (c) foldably joining at least one lower flap to a lower edge of the respective one of the at least three panels and secured thereto, the at least one lower flap having an adhesive means thereto, and folded inwardly therefrom to close the lower end of the structure and for attaching to the product to prevent the label from rotating out of view from the viewing opening; and (d) foldably joining at least one upper flap to an upper edge of the respective one of the at least three panels and secured thereto for closing the upper end of the structure; (e) whereby the product is retained within the structure and the adhesive means prevents the label of the product from rotating out of view from the viewing opening.

Alternatively defined more broadly, the present invention is a method of retaining a product or container within a carton to prevent a label from rotating out of view, the method comprising the steps of: (a) forming a structure having a circumferential sidewall, a top wall for closing an upper end of the structure, and a bottom wall for closing a lower end of the structure; (b) cutting an opening on the sidewall for viewing and displaying the label of the product or container; and (c) providing a sealing location on the structure and having an adhesive means thereon for attaching the product or container and preventing the label of the product or container from rotating out of view from the viewing opening; (d) whereby the product or container is retained within the structure and the adhesive means prevents the label of the product from rotating out of view from the viewing opening.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A shadow carton for retaining and displaying therein a cylindrical shaped product or container having a label on its exterior surface, the shadow carton comprising:

a. a front wall panel, an opposed rear wall panel, a first sidewall panel, and an opposed second sidewall panel, foldably joined to each other to form a rectangular shaped structure open at upper and lower ends, the front wall panel having a display opening for viewing the label on the exterior surface of said cylindrical shaped product or container;

b. a pair of lower side closure flaps foldably joined to lower edges of said first and second sidewall panels, and folded inwardly toward each other such that their adjacent free edges abut against each other at a center of said rectangular shaped structure, each lower side closure flap having an adjacent recess that cooperate with each other to form a common opening;

c. a lower inner closure flap foldably joined to a lower edge of said front wall panel and having a central opening located adjacent to the lower edge of said front wall panel, the inner closure flap folded inwardly over said pair of lower side closure flaps such that the central opening is parallel to and corresponds with said common opening;

d. a lower outer closure flap foldably joined to a lower edge of said rear wall panel and having an adhesive means located opposite to the lower edge of said rear wall panel, the outer closure flap folded inwardly toward said front wall panel to close said lower end of said rectangular shaped structure such that the adhesive means adheres to said inner closure flap in overlapped relationship, where the adhesive means extends through said central opening and said common opening for attaching to said cylindrical shaped product or container to prevent said label from rotating out of view from said display opening;

e. a pair of upper side closure flaps foldably joined to upper edges of said first and second sidewall panels and folded inwardly therefrom toward each other such that their adjacent free edges abut against each other;

f. an upper inner closure flap foldably joined to an upper edge of said front wall panel, and folded inwardly therefrom toward said rear wall panel and over said pair of upper side closure flaps; and g. an upper outer closure flap foldably joined to an upper edge of said rear wall panel and folded inwardly therefrom toward said front wall panel and over and secured to said upper inner closure flap to close said upper end of said rectangular shaped structure in overlapped relationship;

h. whereby said cylindrical shaped product or container is retained within said rectangular shaped structure and said adhesive means prevents said label on said product or container from rotating out of view from said display opening.

2. The shadow carton in accordance with claim 1 wherein said upper outer closure flap further comprises a tear away portion with a lift tab, which can be torn off to open said shadow carton to remove said cylindrical shaped product.

3. The shadow carton in accordance with claim 1 wherein said rectangular shaped structure is formed from a unitary blank of foldable paperboard.

4. A carton for retaining and displaying therein a product or container having a label on its exterior surface, the carton comprising:

a. two opposed pairs of first and second wall panels foldably joined to each other to form a structure open at upper and lower ends, one of the first pair of wall panels having a display opening for viewing the label on said product or container;

b. a pair of lower flaps foldably joined to lower edges of said second pair of wall panels, and folded inwardly toward each other such that their adjacent free edges abut against each other, each lower flap having an adjacent slit that cooperates with each other to form a common opening;

c. a lower inner flap foldably joined to a lower edge of one of said first pair of wall panels and having an opening therethrough, the lower inner flap folded inwardly over said pair of lower flaps such that the opening is located parallel to and corresponds with said common opening;

d. a lower outer flap foldably joined to a lower edge of the other one of said first pair of wall panels and having an adhesive means thereon, the lower outer flap folded inwardly toward one of said first pair of wall panels to close said lower end of said structure such that the adhesive means adheres to said lower inner flap in overlapped relationship, where the adhesive means also extends through said opening and said common opening for attaching to said product and preventing said label from rotating out of view from said display opening;

e. a pair of upper flaps foldably joined to upper edges of said second pair of wall panels and folded inwardly therefrom toward each other such that their adjacent free edges abut against each other;

f. an upper inner flap foldably joined to an upper edge of one of said first pair of wall panels, and folded inwardly therefrom and over said pair of upper flaps; and g. an upper outer flap foldably joined to an upper edge of the other one of said first pair of wall panels and folded inwardly therefrom over and secured to said upper inner flap to close said upper end of said structure in overlapped relationship;

h. whereby said product or container is retained within said structure and said adhesive means prevents said label on said product or container from rotating out of view from said display opening.

5. The carton in accordance with claim 4 wherein said upper outer flap further comprises a tear away portion with a lift tab, which can be torn off from to open said carton to remove said product.

6. The carton in accordance with claim 4 wherein said structure is formed from a unitary blank of foldable paperboard.

7. A method of retaining a cylindrical shaped product or container within a shadow carton to prevent a front label on said product or container from rotating out of view, the method comprising the steps of:

a. foldably joining a front wall panel, an opposed rear wall panel, a first sidewall panel, and an opposed second sidewall panel to each other to form a rectangular shaped structure open at upper and lower ends;

b. cutting a display opening on said front wall panel for viewing said label on said cylindrical shaped product or container;

c. foldably joining a pair of lower side closure flaps to lower edges of said first and second sidewall panels, and folded inwardly toward each other such that their adjacent free edges abut against each other at a center of said rectangular shaped structure d. cutting an adjacent recess on said each lower side closure flap that cooperate with each other to form a common opening;

e. foldably joining a lower inner closure flap to a lower edge of said front wall panel and having a central opening located adjacent to the lower edge of said front wall panel, the inner closure flap folded inwardly over said pair of lower side closure flaps such that the central opening is parallel to and corresponds with said common opening;

f. foldably joining a lower outer closure flap to a lower edge of said rear wall panel and having an adhesive means located opposite to the lower edge of said rear wall panel, the outer closure flap folded inwardly toward said front wall panel to close said lower end of said rectangular shaped structure such that the adhesive means adheres to said inner closure flap in overlapped relationship, where the adhesive means extends through said central opening and said common opening;

g. further attaching said cylindrical shaped product or container with said adhesive means to prevent said label on said cylindrical shaped product or container from rotating out of view from said display opening;

h. foldably joining a pair of upper side closure flaps to upper edges of said first and second sidewall panels and folded inwardly therefrom toward each other such that their adjacent free edges abut against each other;

i. foldably joining an upper inner closure flap to an upper edge of said front wall panel, and folded inwardly therefrom toward said rear wall panel and over said pair of upper side closure flaps; and j. foldably joining an upper outer closure flap foldably joined to an upper edge of said rear wall panel and folded inwardly therefrom toward said front wall panel and over and secured to said upper inner closure flap to close said upper end of said rectangular shaped structure in overlapped relationship;

k. whereby said cylindrical shaped product or container is retained within said rectangular shaped structure and said adhesive means prevents said label of said product or container from rotating out of view from said display opening.

8. The method in accordance with claim 7 further comprising the step of providing a tear away portion with a lift tab on said upper outer closure flap, which can be torn off to open said shadow carton to remove said cylindrical shaped product or container.

9. The method in accordance with claim 7 further comprising the step of forming said rectangular shaped structure from a unitary blank of foldable paperboard.

10. A carton for retaining and displaying therein a product or container having an indicia, comprising:

a. at least three panels foldably joined to each other to form a structure open at upper and lower ends, a respective one of the at least three panels having an opening for viewing the indicia on the product or container;

b. a lower inner flap foldably joined to a lower edge of one of said at least three panels and having an opening therethrough;

c. a lower outer flap foldably joined to a lower edge of another one of said at least three panels and having an adhesive means thereon, wherein the adhesive means extends through said opening of said lower inner flap for attaching to said product or container and preventing the indicia from rotating out of view from said viewing opening of said respective one of said at least three panels; and d. at least one upper flap foldably joined to an upper edge of the respective one of said at least three panels and secured thereto for closing said upper end of said structure;

e. whereby said product or container is retained within said carton and said adhesive means prevents said indicia of said product or container from rotating out of view from said viewing opening.

11. The carton in accordance with claim 10 wherein said at least one upper flap further comprises a tear away portion with a lift tab, which can be torn off to open said carton to remove said product or container.

12. The carton in accordance with claim 10 wherein said structure is formed from a unitary blank of foldable paperboard.

13. The carton in accordance with claim 10 wherein said structure is generally rectangular in shape.

14. A carton for retaining and displaying therein a product or container having indicia, comprising:

a. a structure having a circumferential sidewall, a top wall for closing an upper end of the structure, a bottom wall for closing a lower end of the structure, an inner wall with an opening located inside the bottom wall, the sidewall having an opening for viewing and displaying the indicia of the product or container; and b. said bottom wall further having an adhesive means extending through said opening of said inner wall for attaching to said product or container and for preventing the indicia of the product or container from rotating out of view from said viewing opening.

15. A method of retaining a product or container within a carton to prevent an indicia from rotating out of view, the method comprising the steps of:

a. foldably joining at least three panels to each other to form a structure open at upper and lower ends;

b. cutting an opening on a respective one of said at least three panels for viewing the indicia of the product or container;

c. foldably joining an inner lower flap to a lower edge of one of said at least three panels and forming an opening in the inner lower flap and folding the inner lower flap inwardly to cover said lower end of said structure;

d. foldably joining an outer lower flap to a lower edge of another one of said at least three panels and placing an adhesive means on the outer lower flap and folding the outer lower flap inwardly over said inner lower flap such that the adhesive means extends through said opening in said inner lower flap for attaching to the product or container to prevent said label from rotating out of view from said viewing opening; and e. foldably joining at least one upper flap to an upper edge of the respective one of said at least three panels and secured thereto for closing said upper end of said structure;

f. whereby said product or container is retained within said structure and said adhesive means prevents said indicia of said product or container from rotating out of view from said viewing opening.

16. The method in accordance with claim 15 further comprising the step of providing a tear away portion with a lift tab on said at least one upper flap, which can be torn off to open said structure to remove said product or container.

17. The method in accordance with claim 15 further comprising the step of forming said structure from a unitary blank of foldable paperboard.

18. A method of retaining a product or container within a carton to prevent an indicia from rotating out of view, the method comprising the steps of:

a. forming a structure having a circumferential sidewall, a top wall for closing an upper end of the structure, a bottom wall for closing a lower end of the structure, and an inner wall joined to the lower end of the structure;

b. cutting an opening in said sidewall for viewing and displaying the indicia of the product or container;

c. forming an opening in said inner wall; and d. providing a sealing location on said bottom wall and placing an adhesive means thereon, which said adhesive means extends through said opening of said inner wall for attaching to said product or container to prevent the indicia from rotating out of view from said viewing opening;

e. whereby said product or container is retained within said structure and said adhesive means prevents the indicia of the product or container from rotating out of view from said viewing opening.

19. The method in accordance with claim 18 further comprising the step of providing a tear away portion with a lift tab on said top wall, which can be torn off to open said carton to remove said product or container.

20. The method in accordance with claim 18 further comprising the step of forming said structure from a unitary blank of foldable paperboard.

* * * * *